United States Patent [19]

Kashiwagi

[11] Patent Number: 4,916,875

[45] Date of Patent: Apr. 17, 1990

[54] TILE-MOUNT PLATE FOR USE IN WALL ASSEMBLY

[75] Inventor: Toshio Kashiwagi, Mitaka, Japan

[73] Assignee: ABC Trading Co., Ltd., Tokyo, Japan

[21] Appl. No.: 220,679

[22] Filed: Jul. 18, 1988

[51] Int. Cl.[4] ..... E04F 13/18

[52] U.S. Cl. ..... 52/302; 52/384

[58] Field of Search ..... 52/387, 386, 385, 384, 52/388, 389, 303, 302, 453, 450, 510, 486, 390, 391

[56] References Cited

U.S. PATENT DOCUMENTS

| | | | |
|---|---|---|---|
| 26,141 | 1/1967 | Hickman | 52/302 |
| 1,661,750 | 3/1928 | Dunbar | 52/510 |
| 1,707,347 | 4/1929 | Dunbar | 52/510 |
| 1,909,625 | 5/1933 | Meier | 52/486 |
| 2,016,918 | 10/1935 | Born | 52/385 |
| 2,066,268 | 6/1936 | Hohner | 52/510 |
| 3,533,206 | 10/1970 | Passeno, Jr. | 52/391 |
| 3,611,664 | 8/1969 | Barbera | 52/486 |
| 3,701,228 | 10/1970 | Taylor | 52/386 |
| 4,262,464 | 4/1981 | Ludowici | 52/510 |

FOREIGN PATENT DOCUMENTS

| | | |
|---|---|---|
| 60-102340 | 7/1985 | Japan . |
| 61-107826 | 7/1986 | Japan . |
| 62-27148 | 2/1987 | Japan . |
| 62-118833 | 7/1987 | Japan . |

*Primary Examiner*—John E. Murtagh
*Assistant Examiner*—Michele A. VanPatten
*Attorney, Agent, or Firm*—Sandler, Greenblum & Bernstein

[57] ABSTRACT

A tile-mount for mounting tiles on a wall surface. The mount plate has at least one projection extending in a longitudinal direction thereof and base portions. The top surface of the projection has vertically spaced engaging members, and, each of tiles has an engaging portion which engages with the engaging members, and when the base portions are connected to a surface of a foundation, a longitudinally extending passageway is formed between the foundation and the mount plate, which passageway allows rain water or condensation to be exhausted therefrom.

17 Claims, 7 Drawing Sheets

TILE-MOUNT PLATE FOR USE IN WALL ASSEMBLY

BACKGROUND OF THE INVENTION

1. Field of the Invention

The present invention relates to a tile mount plate, which is used for mounting tiles on the surface of a wall assembly of a structure, and, in particular, is preferably used when a foundation for tiles and a support body thereof are made from a material such as wood which is easily damaged by moisture.

2. Description of the Related Art

A tile is essentially a fired clay product that has a high degree of physical stability and and color stability. Accordingly, tiles are widely used for the outer walls of buildings and the like, which require durability against, for example, weather conditions, and outer or inner walls of various structures for which the effect of color or material is of importance. In this connection, when tiles are mounted to a surface of a wall, such as an outer wall of a building made from wood, a method is conventionally used wherein a foundation is formed by a surface wall made from, for example, plywood, to which are adhered an inorganic substance plate and a waterproof sheet. Then, marking of the positions for attaching tiles is carried out, and the tiles are pressed, one by one, onto the marked positions and adhered thereto by a cement mortar or latex mortar, and thus the tiles are mounted in the desired pattern.

This method, however, suffers from the disadvantage that the tiles must be individually adjusted to ensure that the position and inclination thereof with respect to the marked lines are correct, and the disadvantage that the tiles must be adhered with a predetermined space between adjacent tiles. Therefore, not only does the work require an expert level of skill, but also a long time is required for carrying out the work, because of the necessity for adjusting the position of the tile while adhering the same to a wall. Furthermore, the precision, i.e., evenness, of the surface of the wall after the mounting of the tiles is affected by the surface condition of the foundation. For example, if a portion of the foundation is not in a even or level condition, the mounting of tiles must be carried out while adjusting the portion that is not level, thereby further complicating the work process and prolonging the period needed for completion of the work.

Furthermore, while a tile usually has physical and color stability, a tile does not elasticity, and it is impossible for the tile to follow an expansion or contraction of the wall. Therefore, a tile adhered to the surface of the wall is easily partially detached or separated from the foundation, even by a small deformation of the support body or by a shrinkage of the mortar adhesive. This permits rainwater to pefmeate the support body if the detached or separated tile is mounted on an outer wall. Where the support body is made from wood, a waterproof sheet is provided as a part of a foundation for the tiles to prevent water on the surface of the tiles from reaching the support body. However, water can flow between overlapped portions of waterproof sheets, because these sheets are usually not sealed at the joints, with the result that water can permeate into the support body. In the case of an inner wall, an ingress of water gathered on the tiles by condensation caused by a temperature difference thereof with respect to the atmospheric air often occurs, and this water is repeatedly frozen, thereby increasing the separation of the tile from the wall causing erosion of the support body, and reducing the strength of the structure as a whole.

Furthermore, a tile directly mounted on a foundation is easily separated therefrom because it is adhered thereto by cement, and thus an accident can occur whereby a person is injured or something is damaged.

SUMMARY OF THE INVENTION

An object of the present invention is to provide a tile-mount plate, by which a precise and easy mounting of tiles can be realized without the necessity for positional adjustment thereof.

Another object of the present invention is to provide a tile-mount plate, capable of preventing the ingress of rain water or condensation on a wall surface into a support body.

Still another object of the present invention is to provide a tile-mount plate capable of preventing a separation of the tiles from the wall surface.

According to one aspect of the present invention, amount plate for tiles is provided which comprises a base portion, at least one longitudinally extending portion defining a top wall projected from the base portion thereby forming a longitudinally extending channel at a rear side of the top wall, and engaging members on said top wall for engaging said tiles.

According to another aspect of the present invention, a wall assembly is provided comprising a foundation as a basic wall and at least one tile-mount plate to be fixed to the foundation, said mount plate defining a base portion, at least one longitudinally extending portion projected from the top surface and spaced from the surface of the foundation so as to define a corresponding venting passageway between the longitudinally extending portion and the foundation, and engaging members projecting outwardly from said top surface, tiles located on the top surface of the mount plate, each of said tiles defining at least one engaging means capable of engagement with the corresponding engaging member of the mount plate, and means for sealing spaces being formed between the adjacent tiles.

DESCRIPTION OF THE PREFERRED EMBODIMENTS

Figure 1:
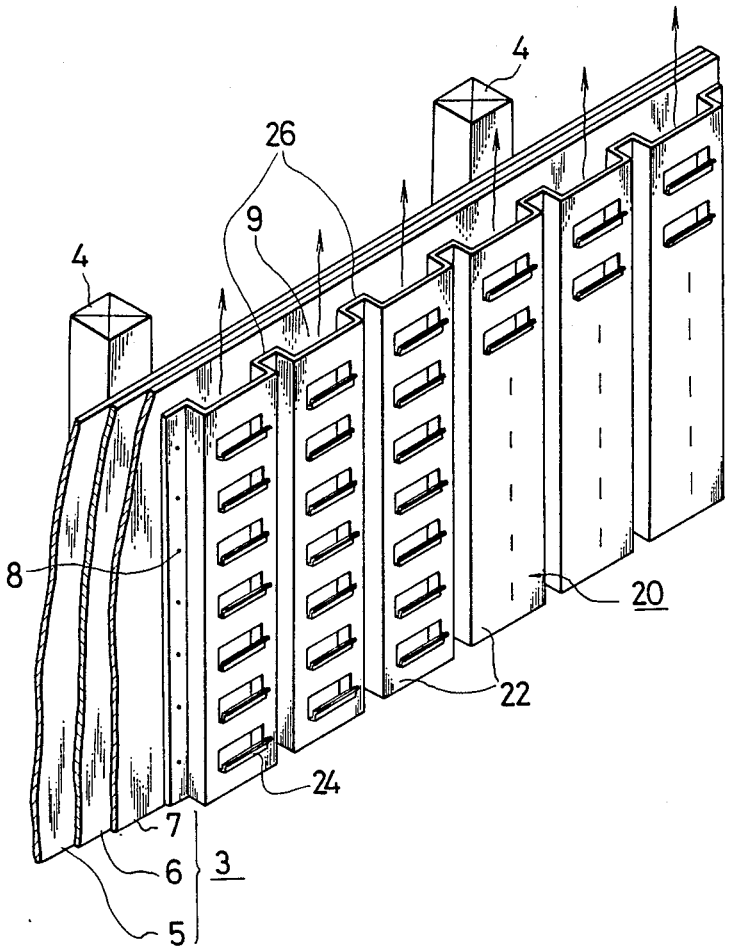
FIG. 1 is a perspective view of a tile-mount plate according to the present invention when connected to the surface of a foundation.
Figure 2:
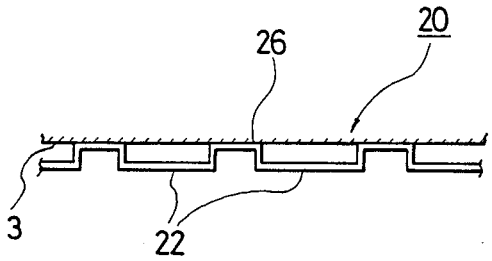
FIG. 2 is a cross-sectional view of the mount plate shown in FIG. 1.
Figure 3:
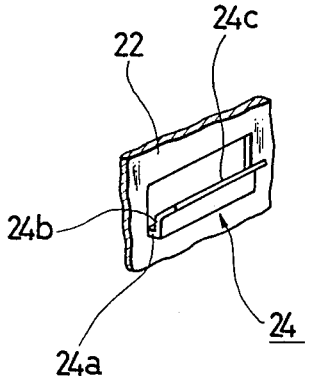
FIG. 3 is a partial perspective view of the mount plate illustrating how an engaging member is constructed.
Figure 4:
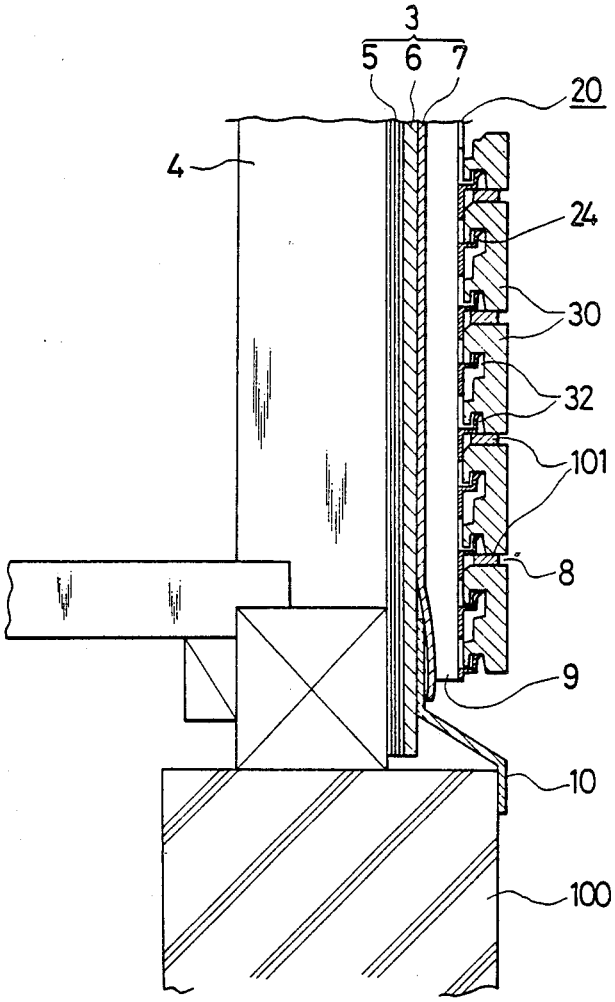
FIG. 4 is a vertical cross-sectional view of the mount plate shown in FIG. 1.

Embodiments of the present invention now will be described with reference to the attached drawings. A mount plate 20 for tiles 30 is located on a foundation 3 which is fixed to pillars 4 as a support body. The mount plate 20 is made from a metal or reinforced plastic corrugated base plate form defining a plurality of horizontally (laterally) spaced and substantially vertically (longitudinally) extending projected portions 22 thereby forming a substantially vertically extending recessed portion or channel at the rear side thereof and a plurality of horizontally spaced and substantially longitudinally extending base portions 26 arranged between the adjacent projected portions 22. The base portions are provided at least at opposite vertical edges of the mount plate 20. The mount plate is shaped by pressing or by extrusion of a metal blank material. On the top surface of each projected portion 22 are formed a plurality of engaging members 24 at a predetermined spacing for engaging respective tiles. The engaging members 24 are formed by punching the plate or welding angled members to the plate. As shown in FIG. 3, each of the engaging members 24 is formed by a horizontally extending first portion **24*a* extending outward from the surface of the plate, second portion 24*b* extending upwardly from the outer end of the first portion 24*a*, and a third portion 24*c* extending upward and forward from the upper end of the second portion 24*b*. As shown in FIG. 4, a tile 30 is provided, at the rear thereof, with two vertically spaced engaging recesses 32, with which the engaging members 24 are engaged. The engaging member 24 may be any shape as long as it can be engaged with the groove 32 and, therefore, is not limited to the particular shape as shown in the figure. In general a tile is a fired clay product, but in the present invention another type of tile, for example, a plastic tile, can be utilized. It should be noted that the extent to which the portion 22 is projected from the base portion 24** is determined in accordance with the type of building and usage thereof. Namely, for a small building for domestic use, the depth thereof will be short, and conversely, the depth will be long for a large building for commercial usage.

Figure 5:
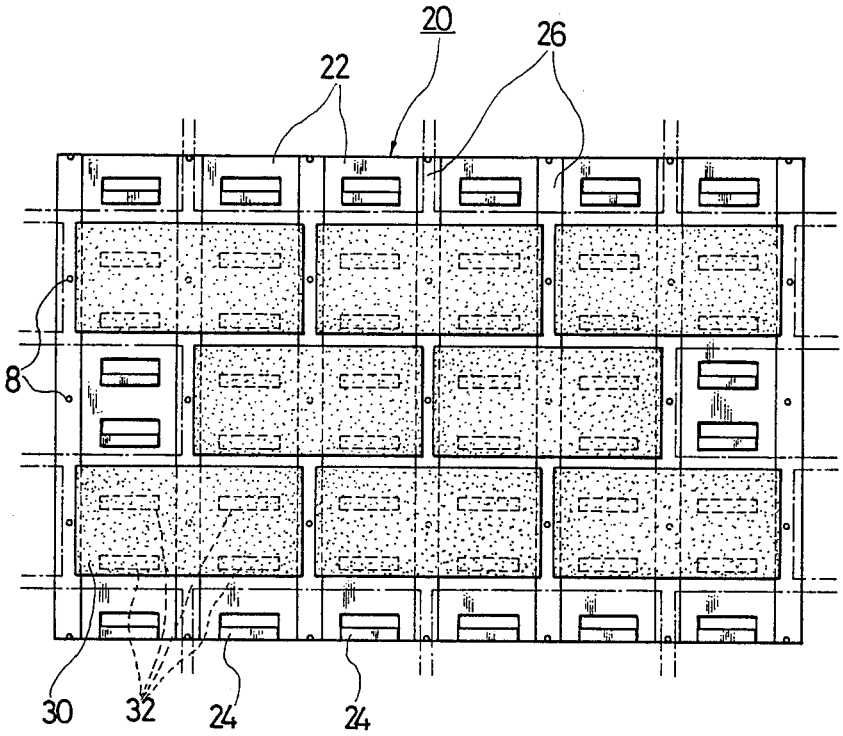
FIG. 5 is a front view of the mount plate with tiles mounted thereon.

The parallel spacing between the projections 22 of the mount t plate 20, and the dimension and position of the engaging members 24, are determined in accordance with the dimension of the tile and an arrangement or layout of the tiles to be mounted. Although, in this embodiment, only one engaging member 24 is formed on a same vertical level of a projection 22, a plurality of engaging members may be formed on the same vertical level. In this embodiment, as shown in FIGS. 4 and 5, each of the tiles is provided, at the rear surface thereof with two vertical rows of horizontally extending engaging grooves 32. Note, each vertical row includes two vertically spaced grooves 32, and the grooves 32 in a row of tiles are aligned with the corresponding grooves 32 in another row of tiles. Each of the tiles engages, at the rear thereof, with two vertically adjacent projections 24 in each of the horizontally adjacent projections 22. Namely, the top surface of each projection 22 is provided with engaging members 24 which form a row in the longitudinal (vertical) direction of the projection 22. A plurality of horizontally spaced such rows are provided, wherein an engaging member 24 in one of such rows is aligned with remaining engaging members 24 in the respective rows. The engaging pieces 24 in the row constitute a plurality of pairs of engaging pieces 24, each of which is engaged with two vertically spaced grooves 32 in a tile. Th tiles 30 can be arranged with respect to the mount plate 20 so that a half width horizontal displacement occurs between the longitudinally (vertically) adjacent tiles. Alternately, each adjacent tile of the vertically spaced tiles can be horizontally aligned.

It should be noted that for execution of the work, the mount panel 20 comprises a single body that has a proper unit area which is determined in accordance with the requirement of easy handling and layouts of the tiles on the entire wall.

When the mount plate 20 is mounted to the wall surface of a wooden building, which is easily damaged by moisture, a fireproof plate 6 of an inorganic material and a waterproof sheet 7 are attached to the surface of a plywood wall portion 5 of a support body 4 to form a foundation 3, and a water prevention plate 10 is arranged on the lower end of the foundation 3. The upper end of the water prevention plate 10 is sandwiched between lower portions of the inorganic plate 6 and waterproof sheet 7, and the lower end of the plate is extending to a base 100, to cover the upper outer surface of the base 100. The mount plate 20 is fixedly connected to the surface of the foundation assembly 3 including the inorganic plate 6 and waterproof sheet 7 by an adhesive. The uppermost end portion of mount plates 20 may be so constituted as to prevent an ingress of water into spaces between the foundation 3 and the projected portions 22 of the mount plate 20. The base portions 26, other than the projected portions 22 facing outward, are fixed by nails 8 or the like directly or via a support member (not shown) arranged transversely with respect to the projected portion 22. In this state, vent passageways 9 are formed between the surface of the foundation 3 and the rear recess of the projections of the tile mount plate 20. The tiles 30 are mounted, one after another, by engaging the engaging grooves 32 of the tile 30 to the corresponding engaging piece 24 of the mount plate 20, as shown in FIG. 4. The mounting of the tiles 30 is very simply carried out by merely engaging the engaging grooves 32 thereof with the engaging pieces 24. In this case, the tiles 30 can be mounted without contact with the nails 8, because the top surface 22 of the mount plate 20 is projected outward from the portion of the mount plate 20 connected to the wall surface by the nails 8. Since the tiles 30 are mounted only by engagement with the engaging members 24, a flat surface is easily obtained, and block 101 of mortar can be used to fill in the spaces between the tiles 30 to obtain a finished wall surface.

The mount plate 20, on which the tiles 30 are mounted, can be attached to an uneven portion of the surface of the foundation, if the uneven portion is smaller than the unit area of the mount plate 20, because the uneven portion is covered by the rear surface of the mount plate 20, and thus the existence of an uneven portion does not have an adverse effect on the outer appearance of the tiles when mounted. Even in the case of a large unleveling portion, a more precise outer surface of the mounted tiles 30 can be obtained, compared with that of the prior art.

Figure 6:
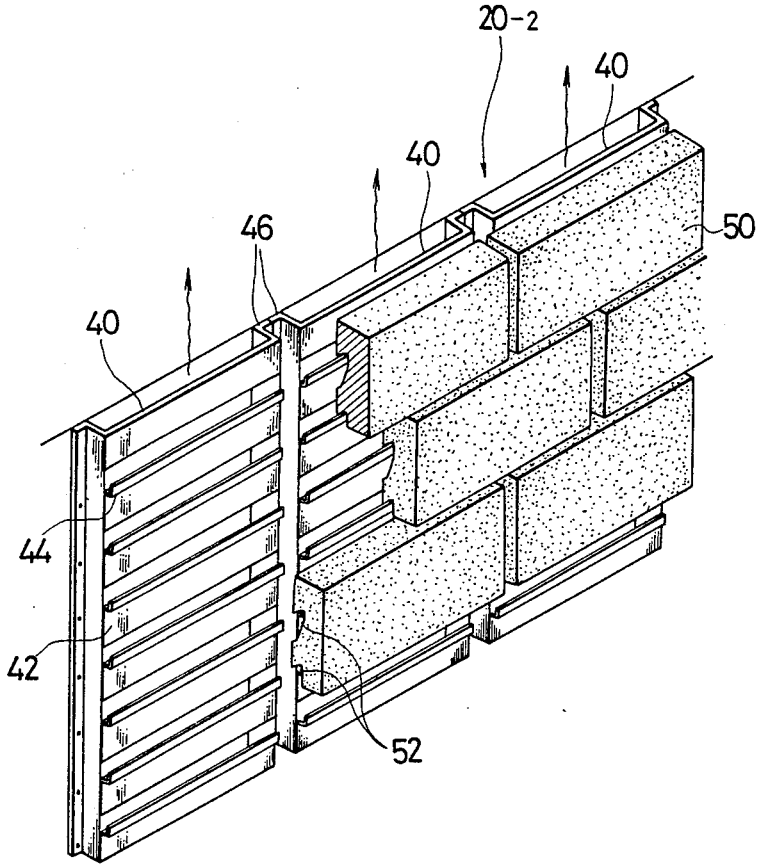
FIG. 6 is a perspective view of the mount plate as a second embodiment, with tiles mounted thereon.
Figure 7:
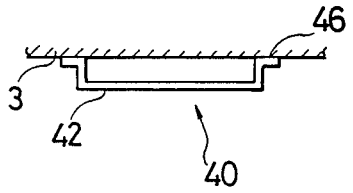
FIG. 7 is a cross-sectional view of the mount plate shown in FIG. 6.

A second embodiment of a tile mount plate 20-2 of the present invention is shown in FIG. 6. This embodiment differs from the first embodiment in that a plurality of separate mount plate pieces 40, which are joined together at the adjacent longitudinal edges thereof, are used to form a unit from a plurality of mount plates 40. Each of the mount plate pieces 40 is formed as a panel which is substantially U-shaped in cross-section, having a projected portion 42 and base or flange portions 46 on the opposite longitudinal sides of the projected portion 42, as shown in FIG. 7. Each of the mount plate pieces 40 forms a plurality of longitudinally spaced engaging members 44, which extend along substantially the entire width of the top or upper surface of the projected portion 42. A plurality of mount plates 40, joined together at the adjacent sides thereof, are arranged in parallel on the surface of the foundation 3 in such a manner that the respective engaging pieces 44 of the adjacent projected portions are aligned in respective horizontal rows and, as a result, tiles 50 can be engaged at any desired position in the lateral direction, thus permitting an increased degree of freedom of mounting of the tiles 50. In the embodiment shown in FIG. 6, the flange portions 46 of each of the mounting pieces 40 are fixed to the surface of the foundation portion so that the adjacent edges of the adjacent mounting pieces are in contact with or located adjacent to each other. The lateral width of the mount plate piece 40 and the engaging member 44 are one to several times the width of the tile 50 to be mounted.

Figure 8:
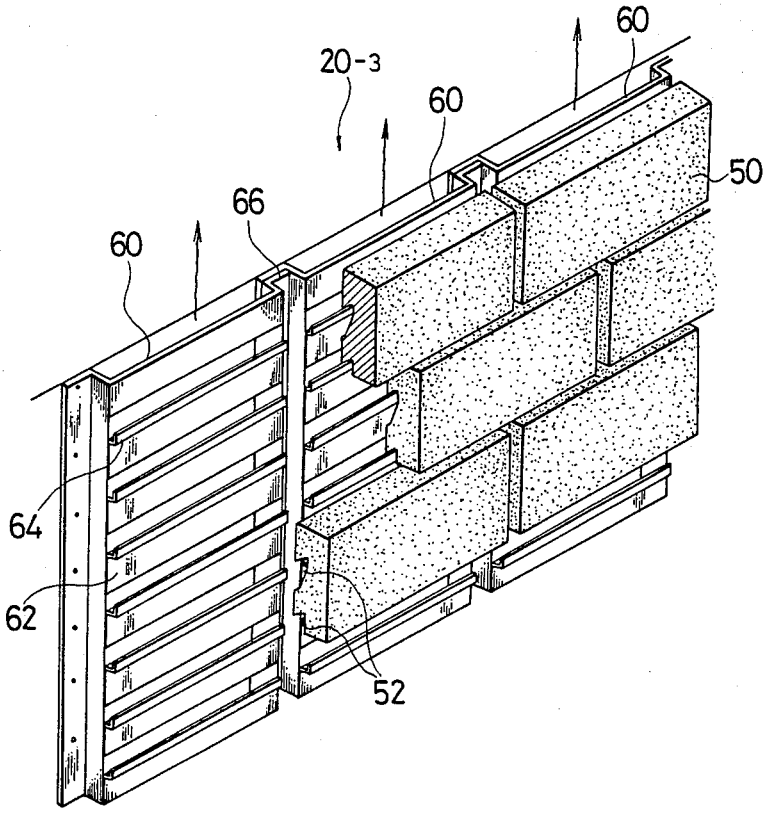
FIG. 8 is a perspective view of another embodiment of the mount plate.
Figure 9:
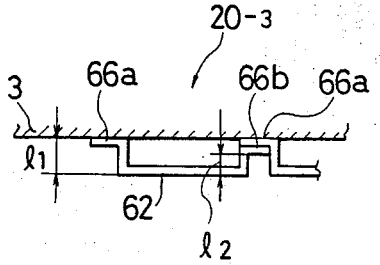
FIG. 9 is a cross-sectional view of the mount plate shown in FIG. 8.

FIG. 8 shows a modification 20-3 of the mount plate shown in FIG. 6. In this modification, the mount plate piece 60 is provided with a first flange portion 66*a* having a length $l_1$ from the top surface of the projected portion 62, and a second flange portion 66*b* at a distance $l_2$ from the top surface of the projected portion 62. As shown in FIG. 9, The difference between $l_1$ and $l_2$ corresponds to the thickness of the web forming the mount plate piece 60. In this embodiment, when the adjacent plate pieces 60 are assembled, the flange portions 66*a* and 66*b* are overlapped so that the deeper flange portion 66*a* of the mount plate piece 60 is located between the foundation surface and the short flange portion. The remaining construction is substantially the same as that shown in FIG. 6.

This double flange construction at the position at which the mount plate piece 60 is to be fixed to the foundation 3 allows a stronger fixing of the mount plate piece 60, thereby permitting heavier tiles to be mounted thereon.

In the embodiment shown hereinbefore, it should not be always necessary to seal the spaces between adjacent tiles by filling those spaces with mortar or the like because when water enters between the foundation 3 and the projected portion of the mounting plate via spaces between adjacent tiles, the water will be capable of easily flowing down along ventilating channels formed by the spaces between the foundation and the rear surfaces of projected portion of the mounting plate.

Figure 10:
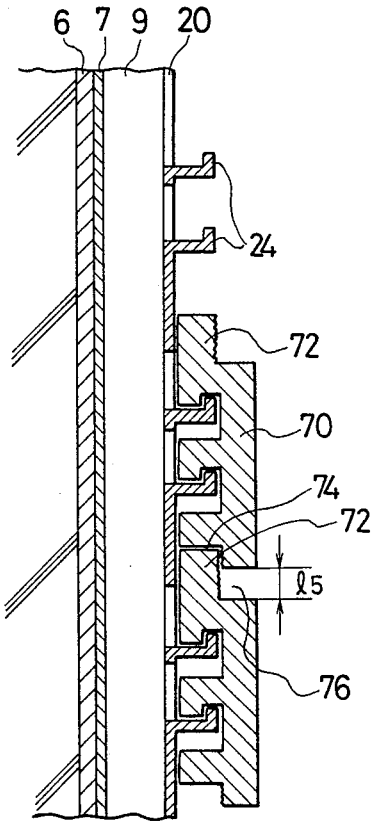
FIG. 10 is a vertical cross-sectional view of the mont plate with tiles of a modified type mounted thereon.
Figure 11:
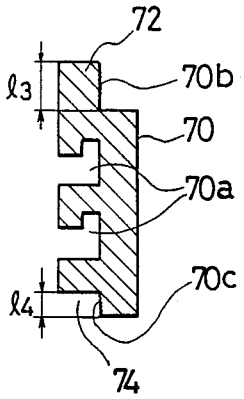
FIG. 11 is a cross-sectional view of a tile in FIG. 10.

In another embodiment shown in FIG. 10, the spaces are not filled by mortar or the like. Namely, the tile 70, in this embodiment, is provided with a projection 72 extending from one inner side of the tile adjacent to the mount plate, and a recess 74 formed on the other inner side of the tile adjacent to the mount plate. As shown in FIG. 11, the length $l_3$ of the projection 72 is larger than that of the recess 74, $l_4$, for a length $l_5$ (FIG. 10) corresponding to a space between the adjacent tiles when mounted. The tile 70 is provided, at the surface thereof facing the mount plate, with engaging grooves 70*a* engaging with coresponding engaging members 24 of the mount plate. When the tiles are individually mounted by using the engaging members and grooves, the projection 72 of each tile is inserted into the recess 74 of the adjacent tile, as shown in FIG. 10, so that a space 76 is formed between the two adjacent tiles. Accordingly, the spaces 76 are sealed inside by the projection extending into the corresponding recess, which constitutes a so-called halving joint, thus eliminating the use of sealing member 101 shown in FIG. 4. This embodiment provides one of dry-type wall assembly without using the mortar sealing means. Furthermore, the surfaces 70*b* and 70*c* of the projection 72 and recess 76 facing each other, may be roughly finished, and these surfaces overlapped with each other when the projection 72 is engaged with the recess 74, thereby preventing an ingress of water.

Incidentally, it will be readily apparent that the aforedescribed tile-mounting plates may not only be arranged in parallel along the lateral direction but also arranged in a longitudinal line by contacting longitudinally adjacent mounting plates.

Furthermore, a wide variety of tile layouts can be obtained, because the positions of engaging members of the mount plate can be determined according to the desired layout.

According to the present invention, as described above, where the mount plate is fixed to the surface of the foundation, such as a wall, and a finished wall surface is obtained by engaging tiles with engaging members on a convex wall of the mount plate, no ingress of rain water to the foundation of the wall assembly can occur even if rain water enters via the spaces between the adjacent tiles, because of the space between the mounted position of the tiles and the wall foundation, at the rear side of the convex surface. If there is an ingress of rainwater or condensation, a formation of a trough part, which is vertically and continuously formed between the convex part of the mount plate and the foundation and opened to the atmosphere at the upper and lower ends thereof, permits the water to flow downward to the outside of the wall via the trough, and permits a constant convection of air in the trough by which the water is vaporized and exhausted outside of the wall, whereby the inside of the mount plate and the foundation surface is always maintained in a dry condition. Thus, an ingress of water to the inside of the support member is prevented, thereby reducing erosion and increasing the strength of the tile mounting.

Furthermore, according to the present invention, the conventional adherence of tiles by mortar is eliminated, since the tiles are mounted merely by engaging the tiles with the engaging members in the mount plate, and therefore, an ingress of water due to deformation of the structure body or through joints, or due to condensation will not cause a separation or detaching of the tiles, thereby preventing damage caused by such a separation of tiles.

When actually worked, a single mount plate is designed to be a suitable size which is easy to handle and on which a desired number of tiles can be mounted, and the mount plates are then fixed, one by one, to the foundation surface. This method of the present invention when compared with the method in the prior art, can reduce the number of reference lines to be marked, thereby reducing the work required for marking. After the mount plates are fixed, one by one, to conform to the reference lines, the tiles can be precisely mounted on the mount plates without the need to adjust the positions of individual tiles required in the prior art. Namely, no particular skill is required for this work.

Further, the tiles can be easily mounted by a mere engagement with the engaging members, thereby shortening the period needed for completion of the work.

Moreover, an uneven portion of the foundation will not adversely effect the outer decorative surface of the tile, and a precise finish of the wall surface is obtained because the tiles are mounted on the foundation by way of a mount plate.

Furthermore, maintenance work of removing tiles totally or exchanging portions of the tiles becomes easier, and the modification of a conventional multi-layer wall to a tiled wall is easily realized because the tiles can be mounted directly onto the conventional multi-layer type wall.

While the present invention is described with reference to the attached drawings, many modifications and changes can be made by those skilled in this art without departing from the scope of the invention.

I claim:

1. A mount plate of a single body for tiles having a corrugated plate form and capable of being mounted on a building foundation as a basic wall, which comprises:

a plurality of base portions capable of being mounted on the foundation, said plurality of base portions being horizontally spaced and extending substantially vertically;

a plurality of projected portions projecting outwardly from and between corresponding adjacent base portions of said plurality of base portions, each of said plurality of projected portions extending substantially vertically and being laterally spaced by base portions so that each of said plurality of projected portions forms a mounting surface for tiles at a top wall thereof, and defines a substantially vertically extending recessed portion between a rear side of a top wall of each of said plurality of projected portions and the foundation; and engaging members formed on each of said top walls of each of said plurality of projected portions for engaging with said tiles, said engaging members being vertically spaced so that at least two of said engaging members are capable of engaging each tile.

2. A mount plate according to claim 1, wherein said plurality of base portions comprise a couple of base portions provided at opposite vertical edges of the mount plate, and at least one base portion located between said couple of base portions.

3. A device for mounting tiles comprising a plurality of mount single body plates adjoining each other along at least one of a lateral and a vertical direction, each of said plurality of mount plates having a corrugated plate form to be mounted on a building foundation, and each of said plurality of mount plates comprising:

a plurality of base portions capable of being mounted on the foundation, said plurality of base portions being horizontally spaced and extending substantially vertically;

a plurality of projected portions projecting outwardly from and between corresponding adjacent base portions of said plurality of base portions, each of said plurality of projected portions extending substantially vertically and being laterally spaced by base portions so that each of said plurality of projected portions forms a mounting surface for tiles at a top wall thereof, and defines a substantially vertically extending recessed portion between a rear side of a top wall of each of said plurality of projected portions and the foundation; and engaging members formed on each of said top walls of each of said plurality of projected portions for engaging with said tiles, said engaging members being vertically spaced so that at least two of said engaging members are capable of engaging each tile.

4. The device according to claim 3, wherein said base portions are formed at least at opposite longitudinal side edges of each of said mount plates, with one of said base portions at one of said longitudinal side edges having a depth smaller than that of the other of said base portions at the other of said longitudinal side edges, and, in two adjacent mount plates, a base portion in one of said mount plates overlaps a base portion having a smaller depth.

5. The device according to claim 3, wherein said plurality of mount plates are arranged in parallel.

6. A wall assembly comprising a foundation as a basic wall;

at least one mount plate for tiles having a corrugated plate form fixed to said foundation, said mount plate for tiles comprising:

a plurality of base portions mounted on said foundation, said plurality of base portions being horizontally spaced and extending substantially vertically;

a plurality of projected top surface portions projecting outwardly from and between corresponding adjacent base portions of said plurality of base portions, each of said plurality of projected top surface portions extending substantially vertically and being laterally spaced by base portions, and defining a substantially vertically extending venting passageway between a rear side of a top wall of each of said plurality of projected portions and said foundation; and engaging members projecting outwardly from said projected top surface portions, said engaging members being vertically spaced so that at least two of said engaging members are capable of engaging each tile; and a plurality of tiles being located on said plurality of top surface portions, with each of said plurality of tiles including at least two engaging means engaging with at least two vertically spaced engaging members.

7. The wall assembly according to claim 6, wherein said mount plate is shaped by pressing of a metal plate.

8. The wall assembly according to claim 6, wherein each of said plurality of tiles further comprises a projection on one side of each tile, and a recess on the other side of each tile, with a projection on one tile being inserted in a recess of an adjacent tile.

9. The wall assembly according to claim 8, wherein said projection on one side of each tile and said recess on the other side of each tile include rough surfaces.

10. The wall assembly according to claim 6, further comprising means for sealing spaces between adjacent tiles.

11. The wall assembly according to claim 10, wherein said sealing means comprise mortar within said spaces.

12. A wall assembly comprising a foundation as a basic wall;

a plurality of mount plates for tiles, with each of said plurality of mount plates having a corrugated plate form fixed to said foundation, each of said plurality of mount plates comprising:

a plurality of base portions mounted on said foundation, said plurality of base portions being horizontally spaced and extending substantially vertically;

a plurality of projected top surface portions projecting outwardly from and between corresponding adjacent base portions of said plurality of base portions, each of said plurality of projected top surface portions extending substantially vertically and being laterally spaced by base portions, and defining a substantially vertically extending venting passageway between a rear side of a top wall of each of said plurality of projected portions and said foundation; and engaging members projecting outwardly from said projected top surface portions, said engaging members being vertically spaced so that at least two of said engaging members are capable of engaging each tile; and a plurality of tiles being located on said plurality of top surface portions, with each of said plurality of tiles including at least two engaging means engaging with at least two vertically spaced engaging members.

13. The wall assembly according to claim 12, wherein said base portions are formed at least at opposite longitudinal side edges of each of said mount plates, with one of said base portions at one of said longitudinal side edges having a depth smaller than that of the other of said base portions at the other of said longitudinal side edges, and, in two adjacent mount plates, a base portion in one of said mount plates overlaps a base portion having a smaller depth.

14. The wall assembly according to claim 12, wherein each of said plurality of tiles further comprises a projection on one side of each tile, and a recess on the other side of each tile, with a projection on one tile being inserted in a recess of an adjacent tile.

15. The wall assembly according to claim 14, wherein said projection on one side of each tile and said recess on the other side of each tile include rough surfaces.

16. A wall assembly according to claim 12, further comprising means for sealing spaces between adjacent tiles.

17. A wall assembly according to claim 16, wherein said sealing means comprise mortar within said spaces.

* * * * *